US008366985B2

(12) United States Patent
Kim

(10) Patent No.: US 8,366,985 B2
(45) Date of Patent: Feb. 5, 2013

(54) METHOD OF MANUFACTURING WATERCOURSE BLOCKS CONTINUOUSLY ARRANGED ON THE SPOT

(76) Inventor: Kyo Chul Kim, Gumi-si (KR)

( * ) Notice: Subject to any disclaimer, the term of this patent is extended or adjusted under 35 U.S.C. 154(b) by 218 days.

(21) Appl. No.: 12/918,479

(22) PCT Filed: Sep. 9, 2008

(86) PCT No.: PCT/KR2008/005317
§ 371 (c)(1),
(2), (4) Date: Aug. 19, 2010

(87) PCT Pub. No.: WO2009/107911
PCT Pub. Date: Sep. 3, 2009

(65) Prior Publication Data

US 2010/0327473 A1 Dec. 30, 2010

(30) Foreign Application Priority Data

Feb. 25, 2008 (KR) ..... 10-2008-0016972

(51) Int. Cl.

| | |
|---|---|
| ***B28B 1/14*** | (2006.01) |
| *E02B 3/00* | (2006.01) |
| *E02B 3/12* | (2006.01) |
| *E02B 3/14* | (2006.01) |
| *E02B 5/00* | (2006.01) |
| *E02B 5/02* | (2006.01) |

(52) U.S. Cl. ..... 264/333; 264/277; 264/297.9; 405/287.1; 405/302.4; 405/302.6; 405/302.7; 249/10

(58) Field of Classification Search ..... 264/277, 264/297.9, 333; 405/187.1, 302.4, 302.6, 405/302.7, 287.1; 249/10
See application file for complete search history.

(56) References Cited

U.S. PATENT DOCUMENTS

| | | | |
|---|---|---|---|
| 4,152,875 | A | 5/1979 | Soland |
| 6,739,797 | B1 | 5/2004 | Schneider |

FOREIGN PATENT DOCUMENTS

| | | | |
|---|---|---|---|
| JP | 09125419 | | 5/1997 |
| KR | 20-0324519 | * | 8/2003 |
| KR | 20-0388790 | * | 7/2005 |
| KR | 20-0403455 | * | 12/2005 |
| KR | 1020070063082 | | 6/2007 |

OTHER PUBLICATIONS

International Search Report for PCT/KR2008/005317 mailed Mar. 20, 2009.

* cited by examiner

*Primary Examiner* — Christina Johnson
*Assistant Examiner* — Patrick Butler
(74) *Attorney, Agent, or Firm* — Christopher Paul Mitchell

(57) ABSTRACT

The present invention relates to a method of manufacturing watercourse blocks continuously arranged in the construction spot, which continuously arranges the watercourse blocks according to the construction spot by preparing iron bar grates to be orthogonal to each other inside molding frames that are continuously arranged, casting concrete, preventing moisture evaporation and frost damage and employing iron bar grates so that the watercourse blocks continuously arranged according to the construction spot can be manufactured and constructed on the spot. Therefore, works for manufacturing the watercourse blocks in a plant and then assembling or fixing them in the construction spot according to the related art can be reduced as much as possible, the watercourse blocks can be simply manufactured and constructed on the spot to reduce a manufacturing cost and a construction time, which can thus significantly reduce the prime cost of the construction cost and diminish accident risk.

1 Claim, 5 Drawing Sheets

METHOD OF MANUFACTURING WATERCOURSE BLOCKS CONTINUOUSLY ARRANGED ON THE SPOT

RELATED APPLICATIONS

This application is a 371 application of International Application No. PCT/KR2008/005317, filed Sep. 9, 2008, which in turn claims priority from Korean Patent Application No. 10-2008-0016972, filed Feb. 25, 2008, both of which are incorporated herein by reference in their entireties.

TECHNICAL FIELD

The present invention relates to a method of manufacturing watercourse blocks continuously arranged on the spot, and more particularly, to a method of manufacturing watercourse blocks continuously arranged in the construction spot, which continuously arranges the watercourse blocks according to the construction spot by preparing iron bar grates to be orthogonal to each other inside molding frames that are continuously arranged, casting concrete and preventing moisture evaporation and frost damage, so that an inclined surface or an embankment made of earth and sand for taking preventive measures against flood damage in summer season can be prevented from being lost due to a flood or a heavy rain and plants can be grown in plant-living spaces.

BACKGROUND ART

In general, watercourse blocks are employed for preventing stacked earth and sand of an embankment or an inclined surface for taking preventive measures against flood from being washed away due to a flood or a heavy rain and thus preventing the embankment from being broken. However, in the case of a city river area where a land use density near the river is high, the river environment has changed due to maintenance of water tank and terrace land on the river, linear maintenance of water channel and construction of river embankment for controlling the flood. As a result, the maintenance of the river area and the inclined surface using the conventional watercourse blocks makes it very difficult to grow plants, an ecosystem is now destroyed in almost all river areas or inclined surfaces, plants are hardly found in the river areas or inclined surfaces to make a dreary environment with concrete structures only, and environmental conversation of the river area is lost, which leads to contamination of the water quality of the river and rapid reduction in number and kind of plants and the fishes and the birds living in the river.

When the conventional watercourse blocks are disposed in the river area and the inclined surface as described above, plants cannot grow so that a green tract of land may be reduced to that extent, the ground on the rear surface of the watercourse blocks may be subsided or the earth and sand may be degenerated to break the ecosystem. Accordingly, when a repair work is done, a large-scaled work is required, which disassembles the watercourse blocks and performs reconstruction.

To cope with these problems, watercourse blocks are proposed in recent years, which are constructed with a plant-living space in the river area or the inclined surface so that the earth and sand can be prevented from being lost and plants can be grown between the watercourse blocks.

However, according to the above-mentioned watercourse blocks, the watercourse blocks are integrated with support units to make a plurality of predetermined upper and lower space gaps by means of molding frame using a cast while the support units are disposed in the molding frame, wherein one unit member such as the integrated watercourse block and the support unit has a width of 1 m in right and left directions, and these unit members have separate connection openings or support protrusion at their sides, are continuously arranged at front, back, right and left positions in the embankment or inclined surface that may be lost and are fixed to each other by means of the side support protrusions and the connection openings.

As such, in order to continuously align the conventional watercourse blocks by closely adhering the blocks to each other in front, back, right and left positions, each of the heavy watercourse blocks must be lift by a heavy equipment to cause many difficulties. And the support protrusions of the watercourse blocks must be connected to each other by means of connection openings in order to fix the continuously arranged positions even when the watercourse blocks are individually and continuously aligned, so that many times are required to fix the watercourse blocks and the connectivity of the watercourse blocks becomes weaker after a long period of time to cause the connectivity to be lost in a severe flood or a heavy rain, thereby losing the functionality of the watercourse blocks.

That is, according to the conventional construct ion method, the watercourse blocks must be individually and continuously aligned and connected to each other in the construction spot so that the construction time becomes longer, and several skilled workers need to individually connect and fix the watercourse blocks to each other so that the heavy equipment must be employed at the time of carrying and mounting the watercourse blocks, which causes the construction work to consume so many times and costs.

In addition, according to the conventional method of manufacturing and constructing the watercourse blocks, a factory land must be prepared for constructing a factory that can manufacture separate watercourse blocks and equipments for manufacturing the watercourse blocks must be prepared in the factory so that many costs are required in its manufacturing method, a predetermined amount of sand, cement and water input to the molding frame are mixed by a mixer, and then mortar is input to the molding frame and hardened through oscillation, which is then covered and fixed by a palette and is rotated in the reverse direction to lift the molding frame by means of the heavy equipment to demold the watercourse blocks so that it is too burdensome.

As such, the watercourse blocks manufactured by the conventional method must be manufactured in the factory, cured and kept in the factory land and carried to the construction spot by the heavy equipment, so that a large land must be secured for keeping the watercourse blocks after curing.

In addition, according to the conventional watercourse blocks, the blocks are not cured within the molding frame but cured on the palette that has demolded the molding frame in order to increase the production amount, so that it is difficult to maintain the original state of the watercourse blocks due to shaking at the time of carrying the blocks by means of the heavy equipment, the product is coarse and the hardness of the product is weakened to fail to use it permanently.

Therefore, according to the conventional method of manufacturing the watercourse blocks, they can be manufactured only in the factory having a predetermined space and equipment to destroy the nature environment due to dust, pollution and noise of the factory so that civil applications may occur, and the manufactured watercourse blocks must be carried for a long or short distance by a heavy truck in a high oil price period, which requires the heavy equipment to load the blocks onto the truck for carrying them to the construction spot and also requires the heavy equipment to unload the blocks. When the heavy truck cannot enter the construction spot, the watercourse blocks must be repeatedly carried again by a small amount so that a high cost for carrying the blocks to the construction spot after manufacturing the blocks in the factory may also be required.

DISCLOSURE OF INVENTION

Technical Problem

It is therefore an object of the present invention to solve the problems as described above by providing a method of manufacturing watercourse blocks, which carries only molding frames of the watercourse blocks to the construction spot, closely and continuously arranges the molding frames with desired shapes in front, back, right and left directions in the construction spot, prepares iron bar grates inside the molding frames to be orthogonal to each other, integrates the iron bar grates with the molding frames that are continuously arranged, casts concrete, covers a vinyl and a lagging material on the cast concrete for blocking sunlight and preventing moisture of the concrete from being evaporated, naturally cures the assembly and demolds the watercourse blocks, so that the watercourse blocks that are continuously arranged and integrated can be manufactured and constructed on the spot.

Technical Solution

In one aspect, the present invention is directed to a method of manufacturing watercourse blocks continuously arranged on the spot, the method includes: a continuous arrangement step of forming protrusions 2 at intersect ions of connection rods 11 disposed orthogonal to each other to prepare plant-living spaces 3 between the protrusions 2 and the connection rods 11, and arranging one or more molding frames 10 having protruded openings 12 and ring plate grooves 13 formed at ends of the connection rods 11 that are orthogonal to each other by closely adhering the protruded openings 12 to each other; a finish step of providing, with caps 20, the respective protruded openings 12 formed at outer circumferences of the molding frames 10 that are continuously arranged to be orthogonal to each other in the continuous arrangement step and providing the ring plate grooves 13 with respective ring plates 30 having ring grooves 31 and rings 32 fixed to the ring grooves to finish the outer circumferences of the molding frames 10; an iron bar grate formation step of preparing a plurality of interval-keeping units 50 made of concrete on top surfaces of the connection rods 11 inside the molding frames that are continuously arranged and crossing straight-line-shaped iron bar grates above the interval-keeping units 50; a cast step of casting concrete into the molding frames 10 that are continuously arranged and finished at the outer circumferences through the iron bar grate formation step; a moisture evaporation preventing step of preparing a vinyl 60 for preventing moistures of the concrete cast on the top surfaces of the molding frames 10 through the cast step from being evaporated; a sunlight blocking step of preparing a lagging material 70 on the top surface of the vinyl prepared by the moisture evaporation preventing step; a natural curing step of naturally curing the concrete cast inside the molding frames 10 in the air after the sunlight blocking step; a removal step of removing the vinyl 60 and the lagging material 70 that are prepared above the molding frames 10 that are continuously arranged after the natural curing step; and a demolding step of demolding the watercourse blocks 1 that are cured inside the molding frames after the removal step.

Advantageous Effects

According to the present Invention as described above, without need of factory land and investment in factory construction and equipment for manufacturing watercourse blocks for taking preventive measures against flood in summer season according to the related art, only molding frames of the watercourse blocks can be continuously arranged with desired shapes in the construction spot, iron bar grates can be disposed to be orthogonal to each other inside the molding frames that are continuously arranged, and concrete can be cast, so that the integrated watercourse blocks continuously arranged by the iron bar grates can be manufactured and constructed on the spot. Therefore, works for manufacturing the watercourse blocks in a plant and then assembling or fixing them in the construction spot according to the related art can be reduced as much as possible, the watercourse blocks can be simply manufactured and constructed on the spot to reduce a manufacturing cost and a construction time, which can thus significantly reduce the prime cost of the construction cost and diminish accident risk.

BRIEF DESCRIPTION OF THE DRAWINGS

FIG. 4 is a cross-sectional view of watercourse blocks taken along the line B-B' of

FIG. 2.

BEST MODE FOR CARRYING OUT THE INVENTION

Figure 1:
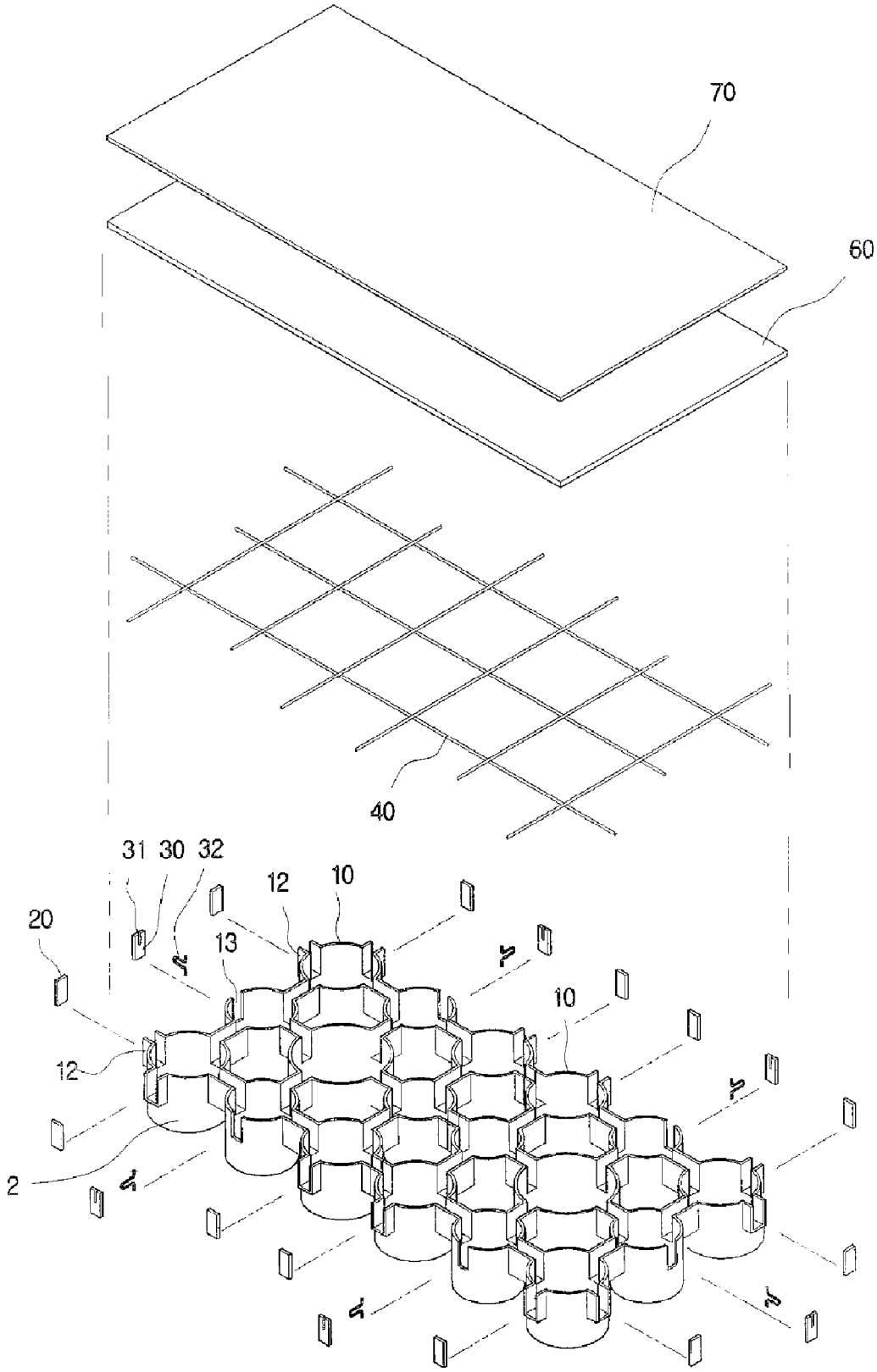
FIG. 1 is a disassembled perspective view for explaining continuous arrangement of watercourse blocks in accordance with an embodiment of the present invention.
Figure 2:
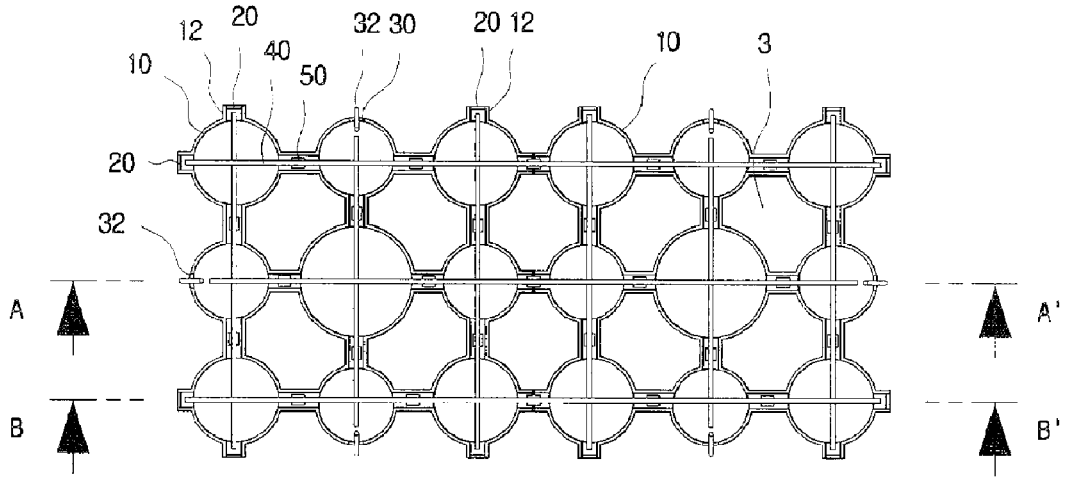
FIG. 2 is a plan view illustrating watercourse blocks in accordance with an embodiment of the present invention.
Figure 3:
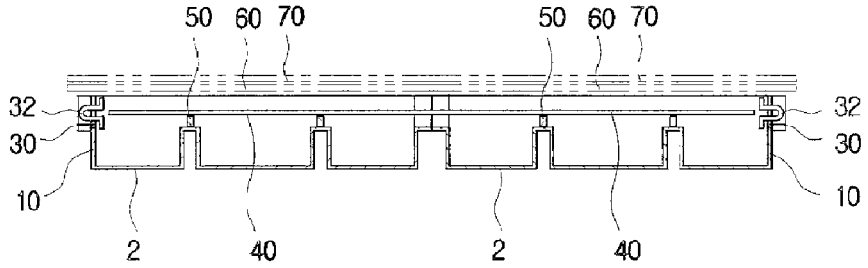
FIG. 3 is a cross-sectional view of watercourse blocks taken along the line A-A' of FIG. 2.
Figure 4:
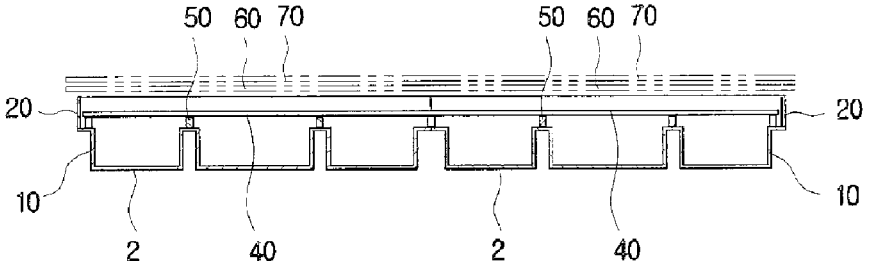
Figure 5:
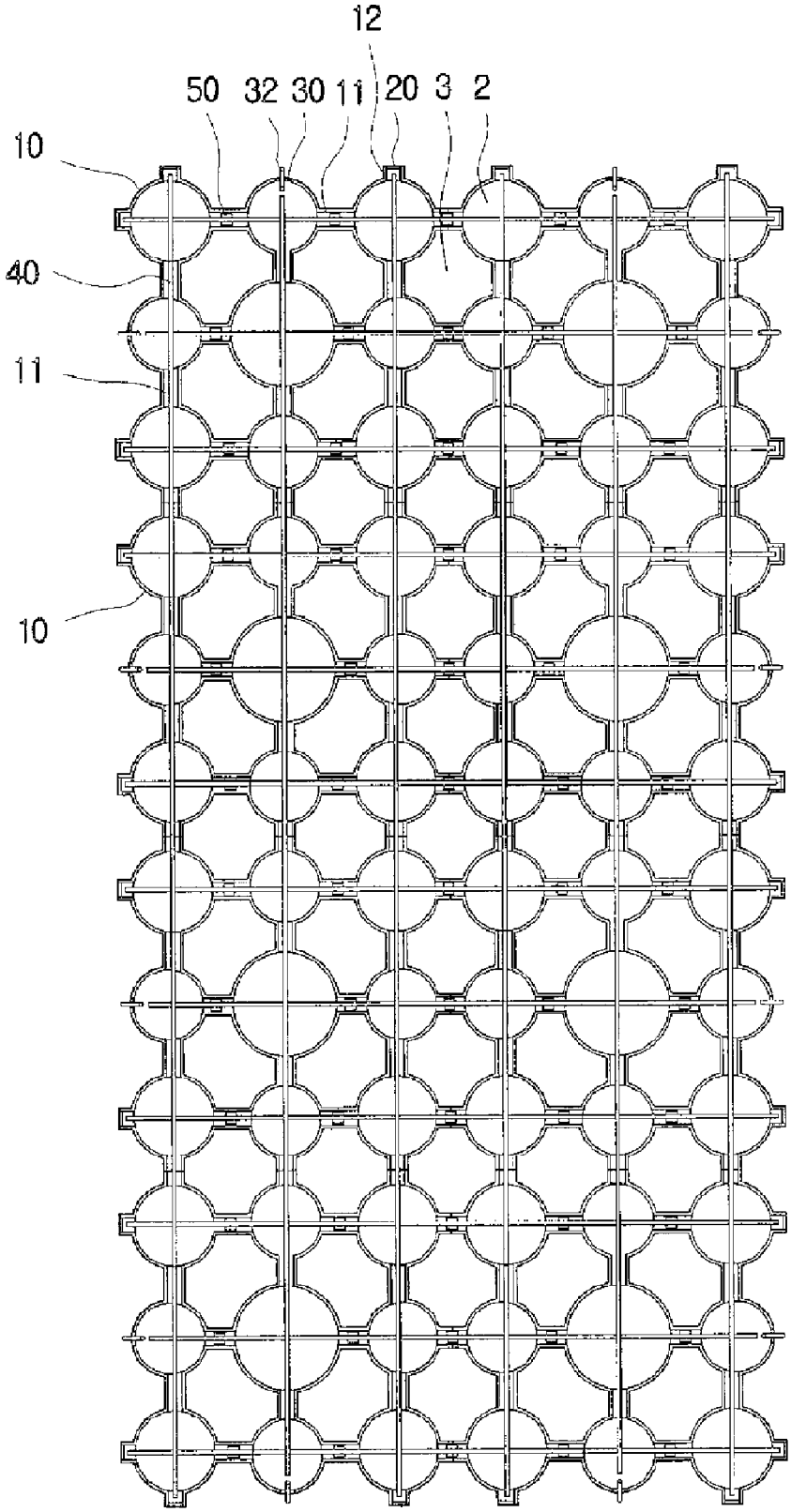
FIG. 5 is a plan view illustrating integrated watercourse blocks that are continuously arranged in accordance with an embodiment of the present invention.
Figure 6:
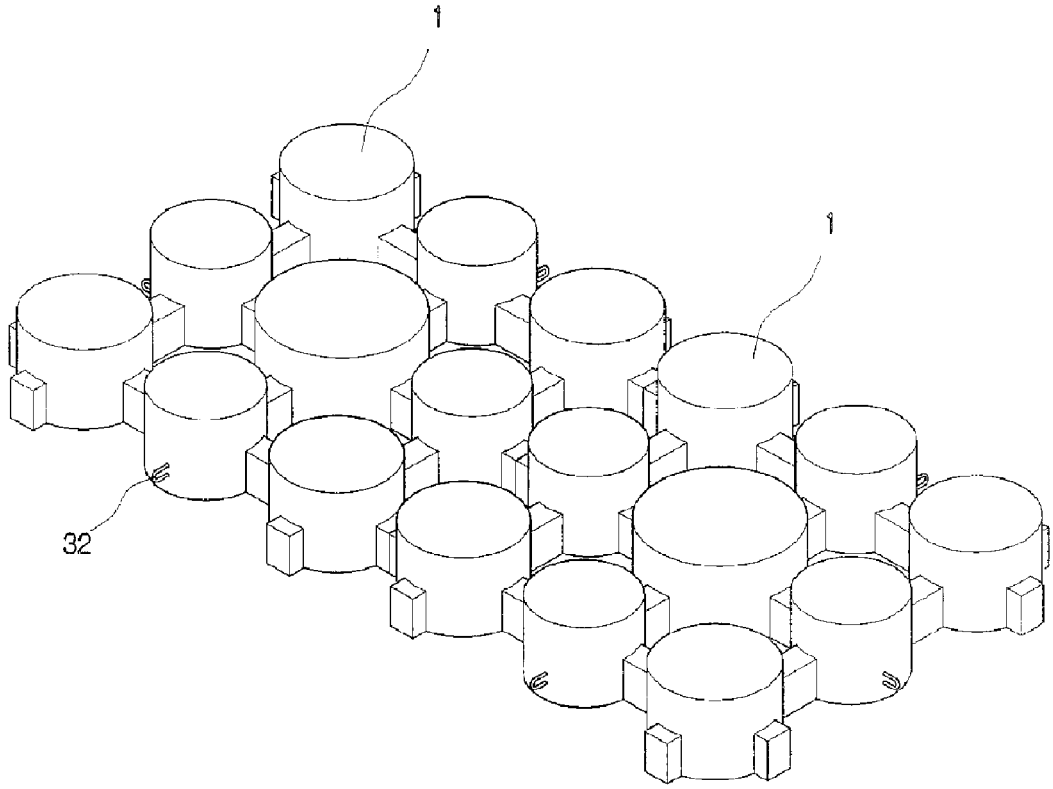
FIG. 6 is a perspective view illustrating integrated watercourse blocks that are continuously arranged in accordance with an embodiment of the present invention.
Figure 7:
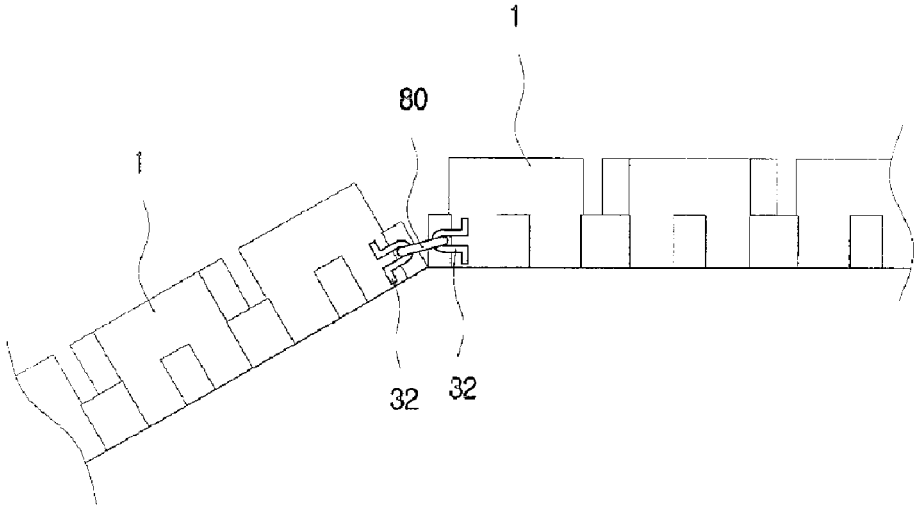
FIG. 7 is a view illustrating watercourse blocks connected at an inclined surface in accordance with an embodiment of the present invention.

A method of manufacturing watercourse blocks that are continuously arranged on the spot includes: a continuous arrangement step of forming protrusions 2 at intersect ions of connection rods 11 disposed orthogonal to each other to prepare plant-living spaces 3 between the protrusions 2 and the connection rods 11, and arranging one or more molding frames 10 having protruded openings 12 and ring plate grooves 13 formed at ends of the connection rods 11 that are orthogonal to each other by closely adhering the protruded openings 12 to each other as shown in FIGS. 1 and 2; a finish step of providing, with caps 20, the respective protruded openings 12 formed at outer circumferences of the molding frames 10 that are continuously arranged to be orthogonal to each other in the continuous arrangement step and providing the ring plate grooves 13 with respective ring plates 30 having ring grooves 31 and rings 32 fixed to the ring grooves to finish the outer circumferences of the molding frames 10; an iron bar grate formation step of preparing a plurality of interval-keeping units 50 made of concrete on top surfaces of the connection rods 11 inside the molding frames that are continuously arranged and crossing straight-line-shaped iron bar grates above the interval-keeping units 50 as shown in FIGS. 2 and 3; a cast step of casting concrete into the molding frames 10 that are continuously arranged and finished at the outer circumferences through the iron bar grate formation step; a moisture evaporation preventing step of preparing a vinyl 60 for preventing moistures of the concrete cast on the top surfaces of the molding frames 10 through the cast step from being evaporated; a sunlight blocking step of preparing a lagging material 70 on the top surface of the vinyl prepared by the moisture evaporation preventing step; a natural curing step of naturally curing the concrete cast inside the molding frames 10 in the air after the sunlight blocking step; a removal step of removing the vinyl 60 and the lagging material 70 that are prepared above the molding frames 10 that are continuously arranged after the natural curing step; and a demolding step of demolding the watercourse blocks 1 that are cured inside the molding frames after the removal step.

The watercourse blocks 1 that have been subjected to the demolding step are continuously arranged and integrated, maintain shapes of the watercourse blocks 1 by means of the straight-line-type iron bar grates 40 disposed inside the blocks, and have the rings 32 protruded at the outer circumferences of the watercourse blocks 1.

The molding frames 10 are continuously arranged, insides of the molding frames 10 are connected by the protruded openings 12, the outer circumferences of the molding frames 10 are finished with the covers 20 and the ring plates 30, the iron bar grates 40 are prepared in the molding frames, concrete is cast therein, which is then covered by the vinyl 60 and the lagging material 70 in the sunlight blocking step, and a veneer board is then disposed on the vinyl 50 and the lagging material 70. The molding frames may be continuously arranged on top of the veneer board in the vertical direction using the continuous arrangement step and the sunlight blocking step, so that a large amount of watercourse blocks 1 can be manufactured regardless of the construction spot.

Figure 8:
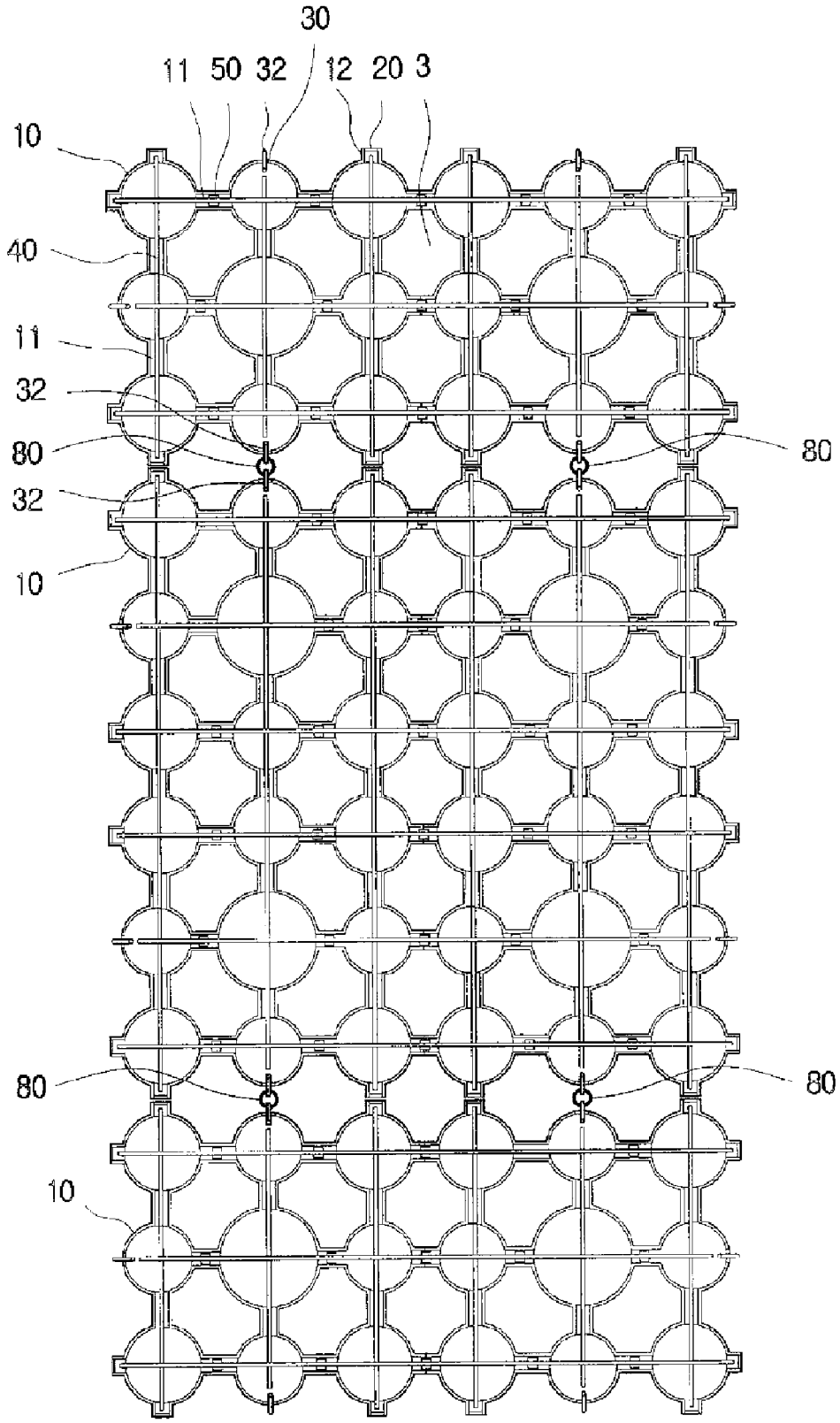
FIG. 8 is a view illustrating watercourse blocks connected in accordance with an embodiment of the present invention.

When the watercourse blocks 1 that are continuously arranged through the demolding step as described above need to be manufactured several times and continuously connected to each other according to the construction spot, the integrated watercourse blocks 1 that are continuously arranged as shown in FIG. 8 are constructed in the desired position of the construction spot, and the rings 32 protruded at the outer circumferences of the watercourse blocks 1 are connected to other watercourse blocks 1 or structures by means of connecting units 80 such as typical metal supporting frames, so that the watercourse blocks can be constructed according to the construction spot.

The iron bar grates 40 formed in the integrated watercourse blocks 1 that are continuously arranged act to maintain the shape of the watercourse blocks 1, and may be adapted to have lengths that are orthogonal to the continuous arrangement of the molding frames 10 suitable for the construction spot.

The method of manufacturing the watercourse blocks that are continuously arranged on the spot for achieving the object of the present invention is as follows. Desired sizes of the watercourse blocks on the spot are first checked, the molding frames 10 with the desired shapes are embodied, one or more molding frames 10 having the protrusions 2 and the plant-living spaces 3 in the connection rods 11 that are orthogonal to each other are closely adhered to each other so that insides of the molding frames 10 are connected by the connection rods, the caps 20 are disposed in the protrusion openings 12 formed at the outer circumferences of the molding frames 10, the ring plate groove 13 are provided with the ring plates 30 and the rings 32 fixed to the ring plates and protruded outside so that the outer circumferences of the molding frames 10 are finished, a plurality of interval-keeping units 50 made of concrete are disposed on the connection rods 11 connecting the molding frames 10, and the straight-line-type iron bar grates 40 are disposed to be orthogonal to each other along the connection rods 11 on the interval-keeping units to make the iron bar grates 40 positioned inside the connection rods 11, so that the iron bar grates 40 can be prevented from being exposed outside at the time of manufacturing the watercourse blocks 1 while tightly fixing the integrated watercourse blocks 1.

When the concrete is cast into the molding frames 10 that are continuously arranged, the construction spot is almost exposed to sunlight, which causes the moisture within the cast concrete to be evaporated so that the concrete may be cracked or weaker. To cope with this problem, the vinyl 60 for preventing the moisture within the concrete from being evaporated due to the sunlight is covered on the cast concrete, and the lagging material 70 for maintaining a proper temperature within the concrete is disposed on the vinyl 60 at the time of natural curing, so that the natural curing can be achieved in the construction spot.

When the integrated watercourse blocks that are continuously arranged after the natural curing step are lift by the heavy equipment such that the molding frames 10 are hung on the rings 32 formed at the outer circumferences of the watercourse blocks 1, the integrated watercourse blocks 1 that are continuously arranged are naturally demolded from the molding frames 10 to complete the manufacturing. The rings 32 protruded at the outer circumferences of the integrated watercourse blocks 1 that are continuously arranged through the demolding step are connected to the rings 32 of other watercourse blocks 1 or are fixed to nearby structures by connecting units 80 such as metal supporting frames to complete the construction.

Therefore, according to the method of the present invention as described above, the integrated watercourse blocks 1 that are continuously arranged on the spot may be demolded from the molding frames 10 by the heavy equipment, and may be immediately aligned and fixed to other watercourse blocks 1 or nearby structures according to the desired positions of the construction spot, so that works for individually aligning and arranging the watercourse blocks and for fixing the positions of the continuous arrangement according to the related art can be removed.

The invention claimed is:

1. A method of manufacturing watercourse blocks continuously arranged on the spot, the method comprising:

a continuous arrangement step of forming protrusions at intersections of connection rods disposed orthogonal to each other to prepare plant-living spaces between the protrusions and the connection rods, and arranging one or more molding frames with at least one molding frame having a protruded opening and at least one molding frame having a ring plate groove formed at ends of the connection rods that are orthogonal to each other by closely adhering the protruded openings to each other;

a finish step of providing, with caps, the respective protruded openings formed at outer circumferences of the molding frames that are continuously arranged to be orthogonal to each other in the continuous arrangement step and providing the ring plate grooves with respective ring plates having ring grooves and rings fixed to the ring grooves to finish the outer circumferences of the molding frames;

an iron bar grate formation step of preparing a plurality of interval-keeping units made of concrete on top surfaces of the connection rods inside the molding frames that are continuously arranged and crossing straight-line-shaped iron bar grates above the interval-keeping units;

a cast step of casting concrete into the molding frames that are continuously arranged and finished at the outer circumferences through the iron bar grate formation step;

a moisture evaporation preventing step of preparing a vinyl for preventing moistures of the concrete cast on the top surfaces of the molding frames through the cast step from being evaporated;

a sunlight blocking step of preparing a lagging material on the top surface of the vinyl prepared by the moisture evaporation preventing step;

a natural curing step of naturally curing the concrete cast inside the molding frames;

a removal step of removing the vinyl and the lagging material that are prepared above the molding frames that are continuously arranged after the natural curing step; and a demolding step of demolding the watercourse blocks that are cured inside the molding frames after the removal step.

* * * * *